United States Patent [19]

Zettier

[11] Patent Number: 4,490,133

[45] Date of Patent: Dec. 25, 1984

[54] SELF-DISCHARGING CENTRIFUGAL DRUM OUTLET VALVE REGULATING DEVICE

[75] Inventor: Karl-Heinz Zettier, Oelde, Fed. Rep. of Germany

[73] Assignee: Westfalia Separator AG, Oelde, Fed. Rep. of Germany

[21] Appl. No.: 366,491

[22] Filed: Apr. 8, 1982

[30] Foreign Application Priority Data

Apr. 21, 1981 [DE] Fed. Rep. of Germany ..... 3115875

[51] Int. Cl.[3] ..... B04B 1/18

[52] U.S. Cl. ..... 494/27; 494/40

[58] Field of Search ..... 494/27, 29, 30, 2, 5, 494/56, 65, 40; 417/395

[56] References Cited

U.S. PATENT DOCUMENTS

| | | | |
|---|---|---|---|
| 2,955,754 | 10/1960 | Nyrop | 494/29 |
| 3,415,446 | 12/1968 | Weiland | 494/2 |
| 3,630,431 | 12/1971 | Oka | 494/29 |
| 3,825,154 | 7/1974 | Jaeger | 417/395 |
| 3,938,734 | 2/1976 | Wilke | 494/30 |
| 3,955,901 | 5/1976 | Hamilton | 417/395 |
| 4,110,058 | 8/1978 | Langle | 417/395 |
| 4,303,376 | 12/1981 | Siekmann | 417/395 |
| 4,305,817 | 12/1981 | Kohlstette | 494/38 |

FOREIGN PATENT DOCUMENTS

| | | | |
|---|---|---|---|
| 173708 | 12/1960 | Sweden | 494/29 |
| 484899 | 9/1975 | U.S.S.R. | 494/2 |

*Primary Examiner*—Samuel Scott
*Assistant Examiner*—Brian J. Bowman
*Attorney, Agent, or Firm*—Sprung Horn Kramer & Woods

[57] ABSTRACT

A device that regulates an outlet valve on a self-discharging centrifugal drum which diverts the closure fluid from a closure compartment that moves the piston valve from a closure position while the solids space is being partly or completely emptied, has, in addition to a supply line that supplies closure fluid to the closure compartment, an operating-fluid line in which a compressed air-controlled operating-fluid meter is positioned downstream of one shut-off and upstream of another shut-off. The meter consists of a housing divided by a tightly stretched and flexible diaphragm into two compartments, one that can be altered in capacity and that accepts operating fluid and a second that can be pressurized. This system ensures that a precise volume of operating fluid will be supplied to the outlet valve and determines the amount of solids to be removed.

7 Claims, 1 Drawing Figure

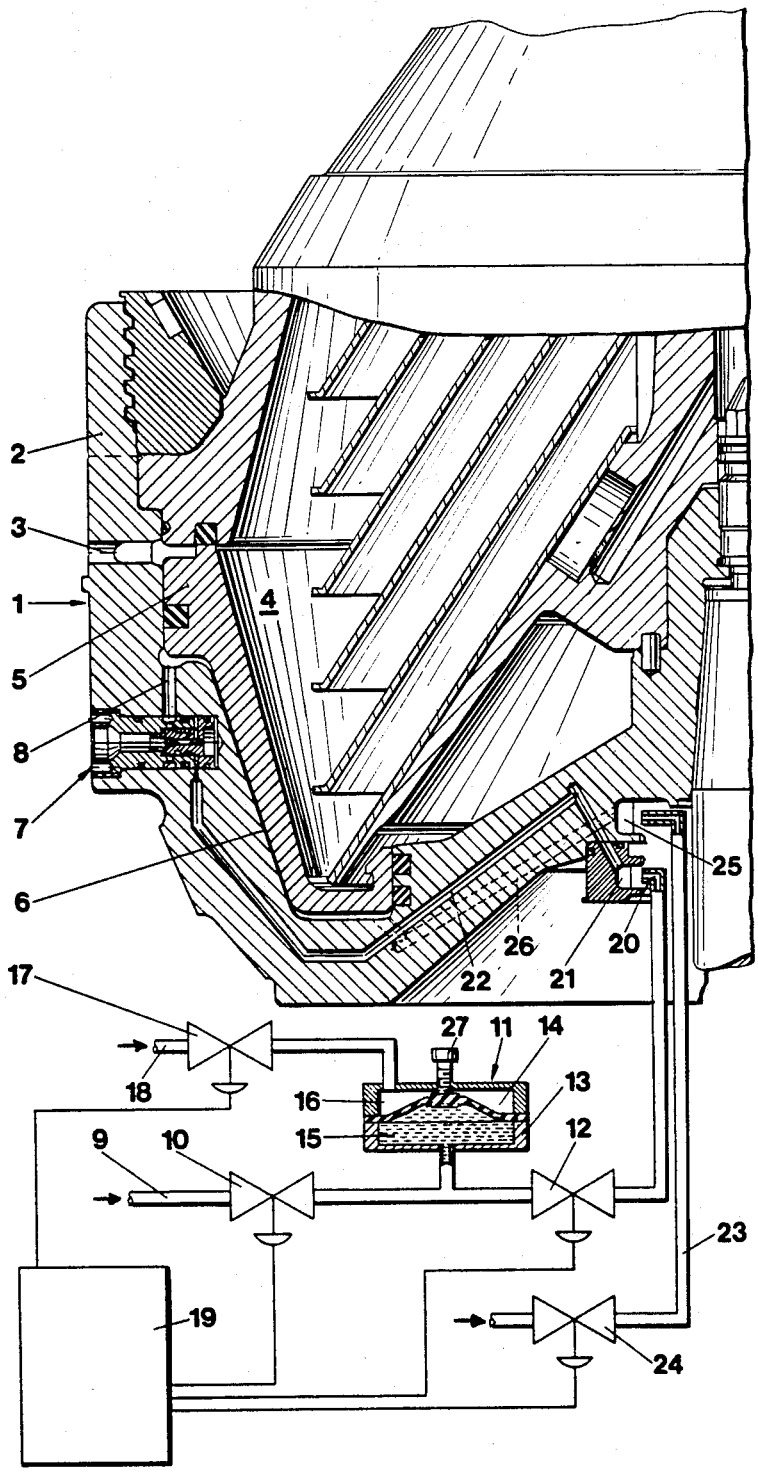
2
3
1
4
5
8
7
6
25
26
20
22
21
17
27
11
14
18
16
13
15
12
9
10
23
19
24

SELF-DISCHARGING CENTRIFUGAL DRUM OUTLET VALVE REGULATING DEVICE

BACKGROUND OF THE INVENTION

The present invention relates to a device that regulates an outlet valve on a self-discharging centrifugal drum, the outlet valve being the type which diverts closure fluid from a closure compartment having a piston valve which delimits a solids space and moves from a closure position while the solids space is being partly or completely emptied. The device has an operating-fluid line with a shutoff, which is connected to a set of controls and which diverts the operating fluid through an annular channel in the shell of the drum and through one or more supply channels to the outlet valve, and has a supply line, which supplies closure fluid to the closure compartment.

Such a device on a self-discharging centrifugal drum, wherein a certain volume of operating fluid is subjected to a certain degree of pressure and supplied to an outlet valve that operates under centrifugal force when the drum empties partly or completely, is known for example from German Pat. No. 2 048 429.

When the drum empties, the solid components of the centrifuged material that accumulate in the solids space must be ejected as rapidly as possible. Whether all of these solids can be ejected uniformly depends on the speed of the axially displaceable piston valve in the drum. At a constant volume of ejection, the more rapidly the piston valve moves into its lower position the larger the gap that opens to permit the solids to be ejected.

Since the amount of solids to be ejected, the drum packing, varies in accordance with whether the drum is discharging partly or completely, the piston valve must either be controlled from outside by timers with the appropriate volume of operating fluid being determined by its existing pressure, or the drum must be provided with a very expensive hydraulics system with, for example, several closure compartments.

In known systems, which are controlled from outside, compromises have always had to be made up to now with respect to piston-valve speed. If the drum was designed for extremely rapid complete discharge, it was extremely difficult to employ timers to achieve precise partial discharge because the discharge periods were too short. The ratio became more deleterious, the larger the separator drum. Another, and major, drawback of time-based control is its dependence on operating-fluid pressure and on any inertia in the operating-fluid shutoffs. If, that is, it is desired that the volume of solids ejected remain constant during the whole operation and with a long opening stroke, very rapid opening in other words, it will not be possible to control the process with timers alone. Such drums can be controlled only by automatic closure with restriction piston valves integrated into the drum. Drawbacks of this type of control are its expense and the impossibility of regulating the volume of solids ejected from outside.

SUMMARY OF THE INVENTION

The present invention is a device of the type mentioned above with a piston valve that can be controlled more precisely with respect to time, at less expense, and independent of fluid pressure and of the time taken by the operating-fluid shutoffs to open, whether the drum is discharging partly or completely.

The invention is characterized by a meter that regulates the flow of operating fluid, that is activated by compressed air, and that is positioned in the operating-fluid line downstream of the shutoff and upstream of a second shutoff.

In the embodiment of the device in accordance with the invention, the meter is supplied with operating fluid to any desired pressure before the drum is discharged, the total volume depending on the extent to which the drum is to be discharged. As soon as discharge is initiated in the drum, the shutoff downstream from the meter suddenly opens; the pressure applied to a diaphragm in the meter forces the operating fluid stored in the meter through the operating-fluid line to the drum.

The variability of the volume of operating fluid in the compartment of the meter can be employed to alter as desired the extent to which the drum is discharged independently of operating-fluid pressure and of the time required by the shutoffs in the operating-fluid line to open.

It is practical to employ controls to regulate the device.

BRIEF DESCRIPTION OF THE DRAWING

One embodiment of the invention will now be specified with reference to the FIGURE wherein the invention is shown partially in cross-section and partially in schematic representation.

DETAILED DESCRIPTION OF THE INVENTION

A self-discharging centrifugal drum 1 of a known type has openings 3 on the periphery of its shell 2 for removing from its solids space 4 the solids separated from a centrifuged liquid. The bottom of the solids space is delimited by an axially displaceable piston valve 5 that is maintained during operation in its upper position, which is the closure position, by a closure compartment 6 mounted on its bottom and filled with closure fluid (see FIGURE). The closure compartment 6 is connected to a fluid-operated outlet valve 7 through an outlet channel 8 for emptying the closure compartment. When the closure compartment 6 is emptied, the piston valve 5 is forced into its lower position by the pressure inside the drum, releasing openings 3 on the periphery of shell 2 for partial or total discharge of solids space 4.

Outlet valve 7 is operated by a mechanism that consists essentially of an operating-fluid line 9, a shutoff 10, a regulating meter 11, and another shutoff 12 downstream of the meter.

Meter 11 consists of a housing 13 divided by a tightly stretched and flexible diaphragm 14 into two compartments, one 15 that can be altered in capacity and that accepts operating fluid and a second 16 that can be pressurized. Compression compartment 16 is connected to a compressed-air line 18 provided with a shutoff 17. Shutoff 10, 12 and 17 are connected to a set of controls 19.

A nozzle-like outlet 20 at the end of operating-fluid line 9 opens into an annular channel 21 in drum shell 2 in the vicinity of its axle. Supply channels 22 lead from annular channel 21 to outlet valve 7.

To fill closure compartment 6 with closure fluid there is a supply line 23 with a shutoff 24 that is connected to controls 19. Supply line 23 opens into another annular channel 25 in drum shell 2. A connecting channel 26 leads from annular channel 25 to closure compartment 6.

The operation of the device will now be described.

When the device is in operation, closure compartment 6 is full of closure fluid, generating a pressure that forces piston valve 5 into the closure position. Before the drum discharges, compartment 15 in meter 11 is filled with operating fluid, initially with shutoff 12 closed and with shutoff 10 open. The volume of operating fluid to be stored in meter 11 is predetermined by a set screw 27 that positions diaphragm 14 in accordance with the desired time to be taken by piston valve 5 to open and hence with the amount of solids to be discharged from solids space 4. Before solids space 4 is discharged and outlet valve 7 accordingly activated, shutoff 10 closes and shutoff 17 in compressed-air line 18 opens, pressurizing compartment 16 above diaphragm 14 with a pressure of at least 2 bar. Once the operating fluid in compartment 15 has been subjected to this pressure, shutoff 12 opens and the operating fluid is forced under high pressure from operating-fluid line 9 into annular channel 21.

The operating fluid is conducted through supply channel 22, which is connected to annular channel 21, to outlet valve 7 which assumes its opening position and diverts the closure fluid from closure compartment 6. Piston valve 5 also assumes its opening position and maintains it as long as operating fluid is being supplied to outlet valve 7 or closure fluid is fed through line 23, annular channel 25, and connecting line 26 to closure compartment 6. Thus controls 19 totally govern the opening and closing process of piston valve 5.

During operation, the capacity of operating-fluid compartment 15 can be changed with set screw 27, varying the amount of solids to be removed from solids space 4.

It is naturally conceivable to employ a piston instead of a diaphragm to regulate the meter.

It will be appreciated that the instant specification and claims are set forth by way of illustration and not limitation, and that various modifications and changes may be made without departing from the spirit and scope of the present invention.

What is claimed is:

1. In a self-discharging centrifugal drum having a solids space, a fluid actuated outlet valve which diverts closure fluid from a closure compartment to move a piston valve from a closure position to an open position wherein the solids space is partly or completely emptied, an actuating fluid line with a first controllable shutoff for supplying an actuating fluid under pressure to the outlet valve, the improvement comprising: a second controllable shutoff downstream of the first shutoff in the actuating fluid line; metering means positioned in the actuating fluid line downstream of the first shutoff and upstream of the second shutoff for storing a predetermined volume of actuating fluid; means for pressurizing the actuating fluid stored by the metering means; and means for selectively controlling the first and second shutoffs and the pressurizing means to apply a predetermined amount of actuating fluid at a predetermined pressure to the outlet valve each time the solids space is to be emptied.

2. The drum according to claim 1, wherein the metering means comprises a housing having a tightly stretched and flexible diaphragm dividing the housing into two compartments, one receptive of the actuating fluid and variable in capacity and the other receptive of a pressurizing fluid.

3. The drum according to claim 2, wherein the metering means further comprises a set screw for limiting the position of the diaphragm to determine the capacity of said one compartment.

4. The drum according to claim 2 or claim 3, wherein said pressurizing means comprises a compressed-air line connected to the other compartment and provided with a third shutoff controlled by said control means.

5. The drum according to claim 4, wherein the pressure in the compressed-air line is at least 2 bar.

6. The drum according to claim 4, wherein the control means to effect emptying, in sequence opens the first shutoff and closes the second shutoff, to permit filling of the metering means thereafter closes the first shutoff and opens the third shutoff to pressurize the fluid in the metering means and then opens the second shutoff to apply the predetermined amount of actuating fluid at a predetermined pressure to the outlet valve.

7. The drum according to claim 1, wherein the actuating fluid line has an outlet comprising a nozzle.

* * * * *